US005236091A

United States Patent [19]

Kauppila et al.

[11] Patent Number: 5,236,091

[45] Date of Patent: Aug. 17, 1993

[54] EDDY CURRENT SEPARATOR AND METHOD OF MAKING A ROTOR

[75] Inventors: Raymond Kauppila, Marquette, Mich.; Gregory Nowak, Girard, Pa.

[73] Assignee: Eriez Manufacturing Company, Erie, Pa.

[21] Appl. No.: 872,094

[22] Filed: Apr. 22, 1992

[51] Int. Cl.[5] ..... B03C 1/00

[52] U.S. Cl. ..... 209/212; 209/636; 335/306

[58] Field of Search ..... 209/212, 606, 631, 636, 209/638; 335/306, 304; 310/156, 43, 45; 29/598

[56] References Cited

U.S. PATENT DOCUMENTS

| | | | |
|---|---|---|---|
| 3,813,098 | 5/1974 | Fischer et al. | 273/72 R |
| 4,150,582 | 4/1979 | Brobeck | 74/572 |
| 4,296,544 | 10/1981 | Burgmeier et al. | 29/598 |
| 4,433,261 | 2/1984 | Nashiki et al. | 310/156 |
| 4,514,245 | 4/1985 | Chabrier | 156/161 |
| 4,528,214 | 7/1985 | Long et al. | 427/173 |
| 4,531,071 | 7/1985 | Kintz, Jr. et al. | 310/156 |
| 4,633,113 | 12/1986 | Patel | 310/156 |
| 4,661,183 | 4/1987 | Beard | 156/172 |
| 4,674,178 | 6/1987 | Patel | 29/598 |
| 4,729,160 | 3/1988 | Brown | 29/598 |
| 4,748,359 | 5/1988 | Yahara et al. | 310/156 |
| 4,869,811 | 9/1989 | Wolanski et al. | 209/212 |
| 4,930,201 | 6/1990 | Brown | 29/598 |

*Primary Examiner*—Robert P. Olszewski
*Assistant Examiner*—Kenneth Noland
*Attorney, Agent, or Firm*—Lovercheck and Lovercheck

[57] ABSTRACT

A magnetic rotor for use with an eddy current separator. The rotor has a plurality of permanent magnets bonded to a polygonal outer periphery and undercuts are formed in the flat surfaces to relieve stresses due to differences in thermal co-efficient of expansion of the permanent magnets and the rotor structure. A carbon filament is wrapped around the permanent magnets under tension overcome the centrifugal force due to rotation of the rotor. The rotor is supported on a bearing sleeve that surrounds the rotor shaft with rotor bearings which support the rotor on the sleeve and the sleeve extends inwardly over the rotor shaft and the shell has shell bearings supported on the sleeve extension. Therefore, the sleeve supports the rotor independent of the shell so that the bearing of the shell and the bearing supporting the rotor are each independent of one another. The sleeve is supported on pillow blocks. The ends of the rotor are clamped to the rotor shaft by means of a locking assembly arrangement. The shell has a heat shield made of ceramic tiles which are fixed to the outside of the shell. The tiles are held to the shell by a suitable netting of non-magnetic material.

13 Claims, 5 Drawing Sheets

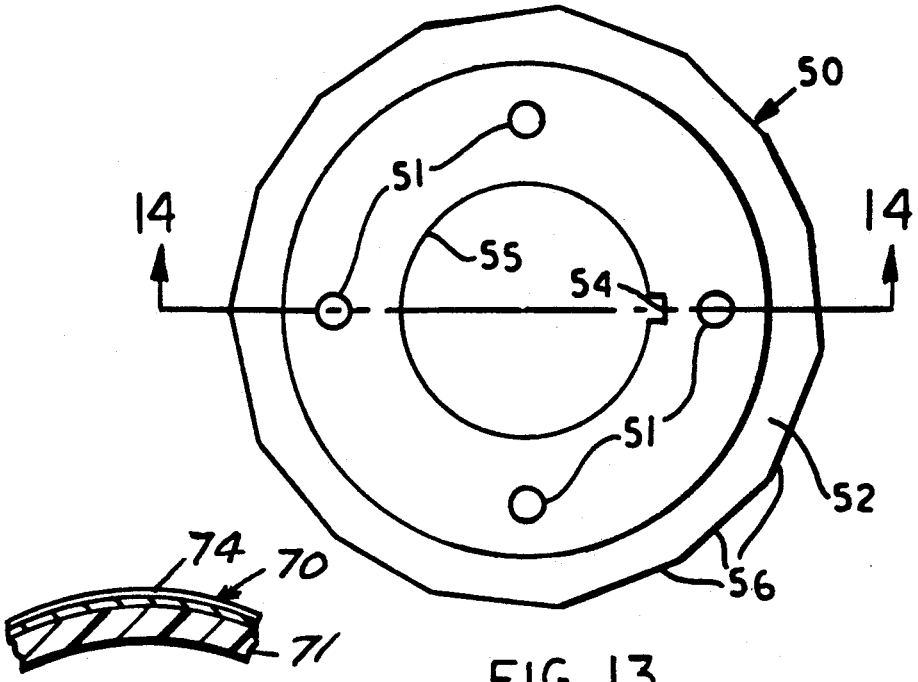
FIG. 12
FIG. 13
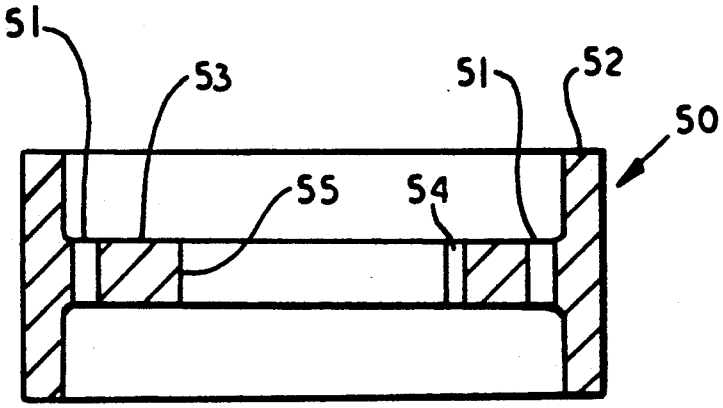
FIG. 14

EDDY CURRENT SEPARATOR AND METHOD OF MAKING A ROTOR

BACKGROUND OF THE INVENTION

It is known in the art that by subjecting non-ferrous metal pieces to a high density, rapidly changing, magnetic flux field, eddy currents are induced in the pieces. The eddy currents produce a repulsive magnetic force in the pieces that is generally proportional to the resistance of metal which comprise the pieces. This repulsive force can cause the respective pieces, when passed through such flux, to be forced away from the field in different trajectories, depending upon the types of metal. Thus, by subjecting substantially similar-size pieces to such a magnetic flux field, their different trajectories permit the pieces to be collected in different containers.

When moving different pieces, of approximately the same size, or different metals through such a rapidly changing, high-density, magnetic flux field, the pieces made of electrically conductive material tend to fly freely a substantial distance from the field. Plastic will be unaffected by the field. Thus, electrically conductive material can be separated from non-conductive materials to produce the required magnetic field, a magnetic rotor may be utilized.

STATEMENT OF THE INVENTION

This invention relates to permanent magnetic rotors, and more particularly to permanent magnet rotors for use in eddy current separators in a manner such that the rotors are rotated at high speeds and are situated inside hollow cylindrical shells which are rotated at a lower speed than the rotor. The rotor, supported on a shaft, is generally cylindrical, and polygonal in cross section. The rotor is constructed of a plurality of rotor segments keyed to the shaft and clamped together by rods forming a rigid rotor assembly. The rotor assembly is keyed and clamped to the rotor shaft at its ends by a ring locking assembly. The rotor segments each have an outer, generally cylindrical, polygonal flange made up of flat surfaces of equal width. Each row of flat surfaces extends from end to end of the rotor and each row supports rows of magnets. Relatively thin rare earth permanent magnets of equal width are cemented to the flat surfaces and held in place by a prestressed carbon filament to withstand the centrifugal forces. The ends of the rotor have an outwardly directed iron flange adjacent the magnets which provide a shunt path for magnetic flux around the ends of the magnets.

The carbon filament is wound around the magnets under sufficient tension to exert at least as great a compressive force on the magnets as the centrifugal force exerted on the magnets by the high speed rotation of the rotor at the design speed of the separator. Thus the bond line of the adhesive has virtually no tensile force thereon during the operation of the separator.

The rotor and the shell are both supported independently on pillow blocks by means of a sleeve. The sleeve is fixed to the pillow blocks and the inside of the sleeve receives the rotor support bearings. The shell support bearings are received on the outside of the extension of the sleeve.

A refractory heat shield made of ceramic tile is supported on the outside of the shell to avoid damage to the shell by pieces of metal that could stick to the shell and be melted by eddy currents.

Applicant is aware of the following prior patents that relate to eddy current separators and rotors: U.S. Pat. Nos. 3,813,098 to Fischer et al; 4,150,582 to Brobeck; 4,296,544 to Burgmeier et al; 4,433,261 to Nashiki et al; 4,514,245 to Chabrier; 4,528,214 to Long et al; 4,531,071 to Kintz, Jr. et al; 4,633,113 to Patel; 4,661,183 to Beard; 4,674,178 to Patel; 4,729,160 to Brown; 4,748,359 to Yahara et al; 4,869,811 to Wolanski et al and 4,930,201 to Brown. None of these patents show an eddy current separator having the features set forth herein.

SUMMARY OF THE INVENTION

It is the object of the invention to provide an improved method of making a rotor for an eddy current separator.

Another object of the invention is to provide an improved rotor.

Another object of the invention is to provide an improved bearing support for an eddy current separator rotor and shell.

Another object of the invention is to provide an improved heat shield and shell structure.

Another object is to provide an improved combination rotor, shell and bearing support.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

FIG. 12 is a partial lateral cross sectional view taken on line 12—12 of FIG. 11.

FIG. 13 is an end view of an intermediate rotor segment.

FIG. 14 is a cross sectional view taken on line 14—14 of FIG. 13.

DESCRIPTION OF THE PREFERRED EMBODIMENT(S)

Figure 1:
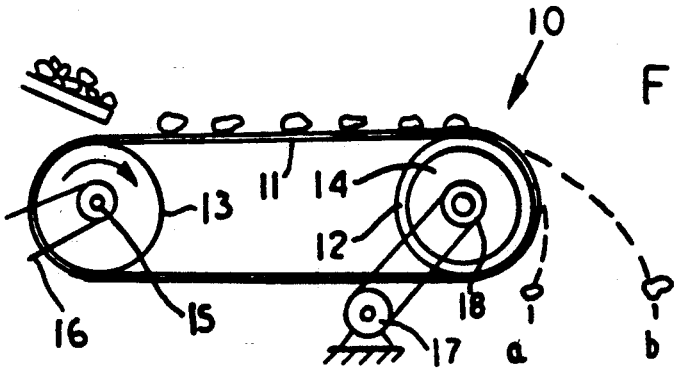
FIG. 1 is a side view of an eddy current separator according to the invention.
Figure 2:
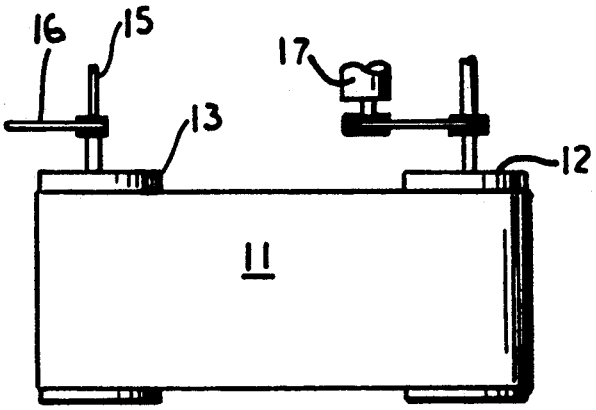
FIG. 2 is a top view of the separator of FIG. 1.
Figure 3:
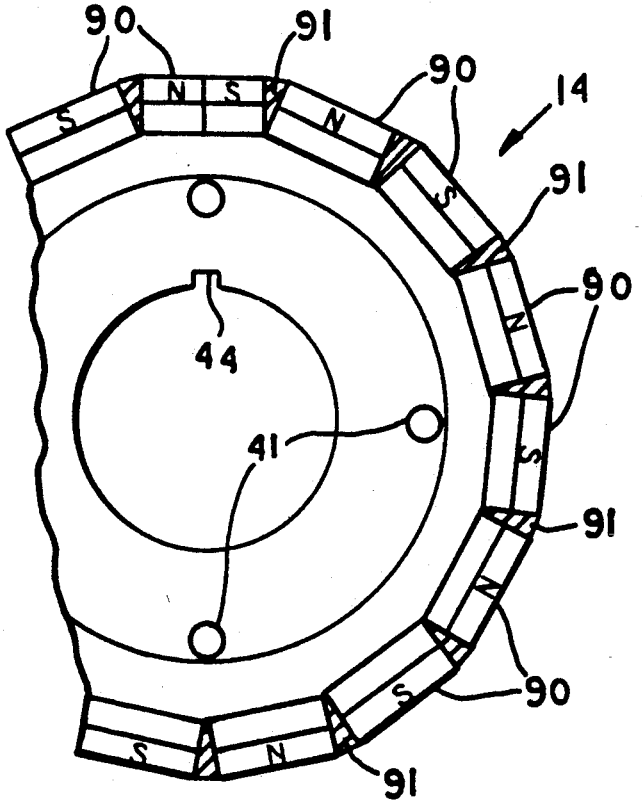
FIG. 3 is a partial end view of the rotor according to the invention.
Figure 4:
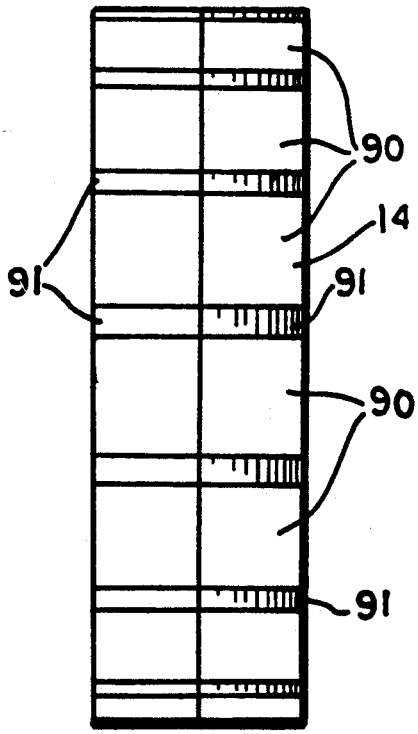
FIG. 4 is a partial top view of the rotor as shown in FIG. 3.

Now with more particular reference to the drawings, separator 10 is shown for separating materials of different electrical conductivity from one another which will be projected from rotor 14, a distance of a or b, depending on the electrical conductivity of the piece. Separator 10 is made up of conveyor belt 11 supported on cylindrical shell 12 and on pulley 13. Pulley 13 is supported on pulley shaft 15 driven by pulley belt 16.

Figure 6:
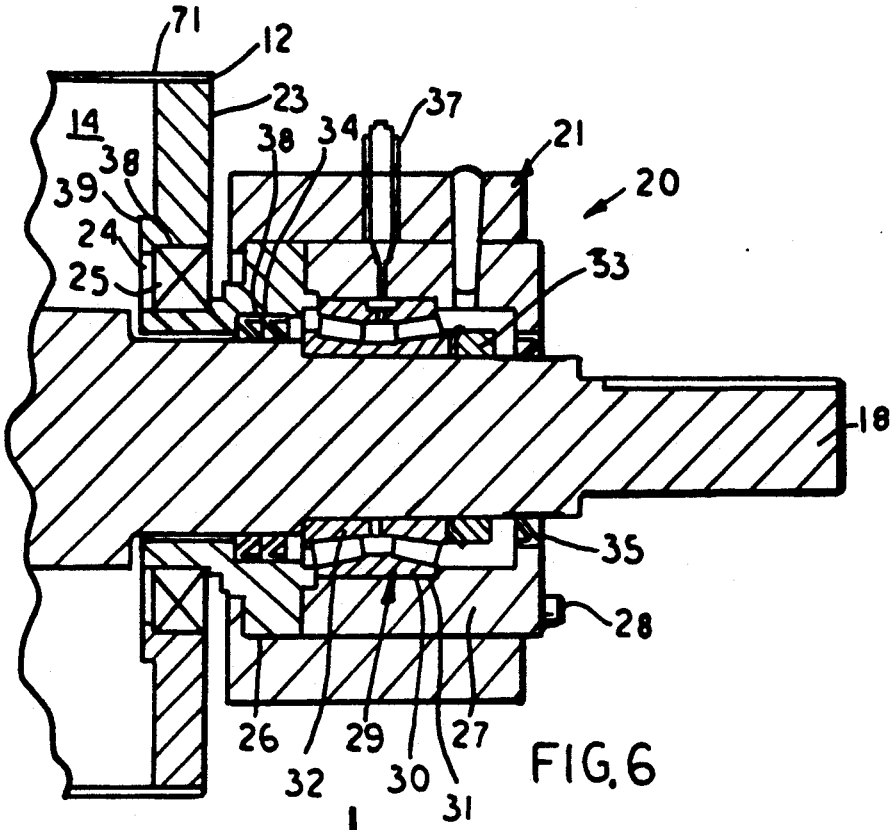
FIG. 6 is a partial longitudinal cross sectional view taken on line 6—6 of FIG. 5 of the separator.
Figure 5:
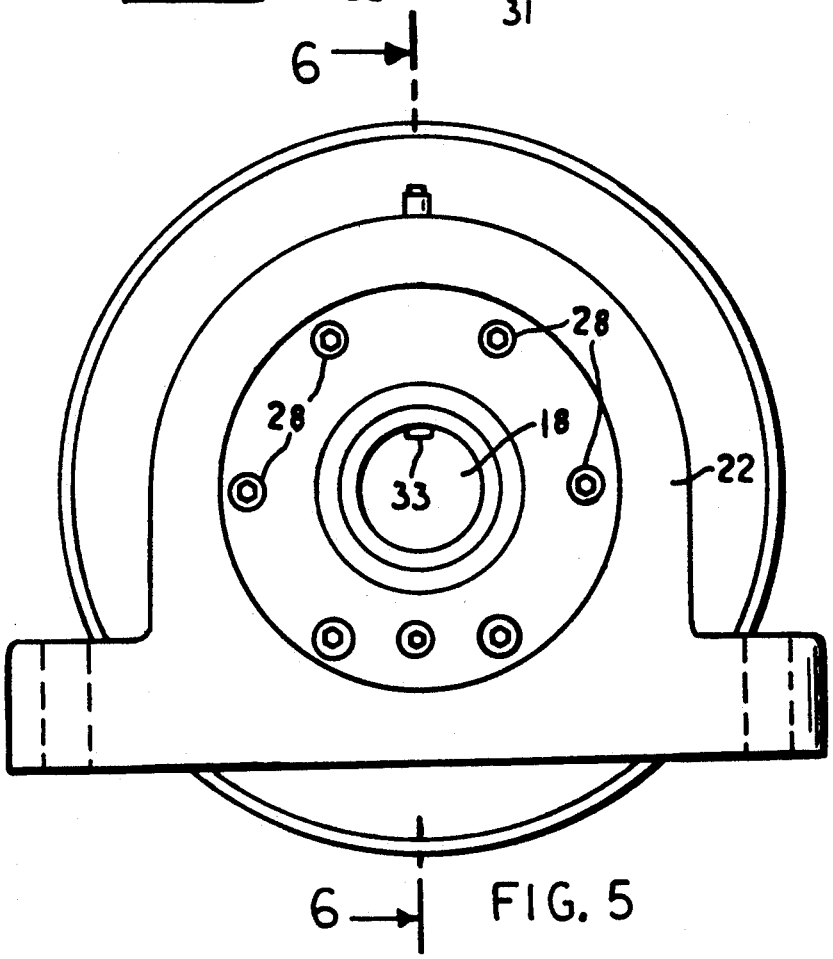
FIG. 5 is an end view of the separator according to the invention.
Figure 7:
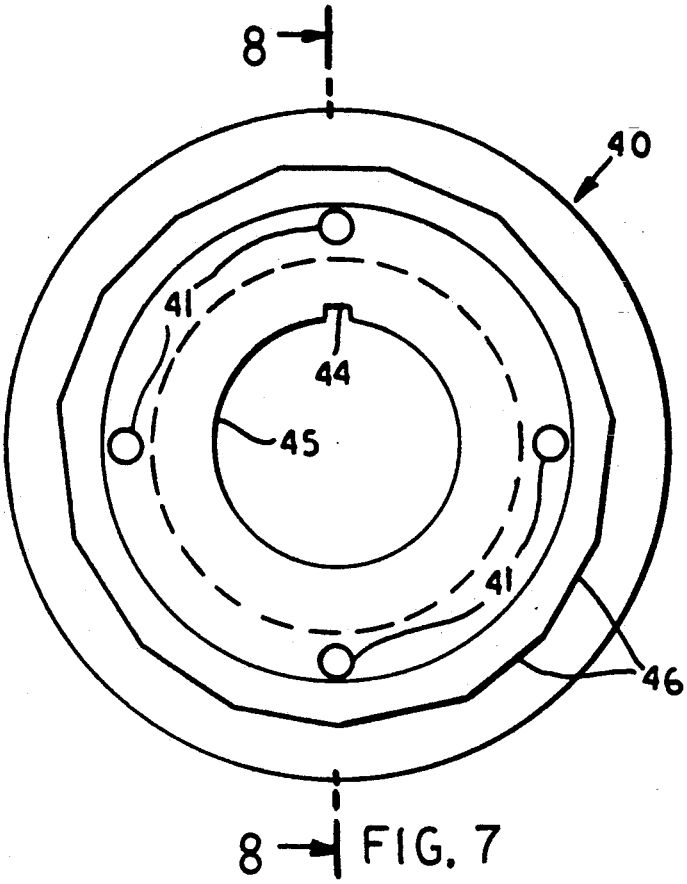
FIG. 7 is an end view of a rotor end segment.
Figure 8:
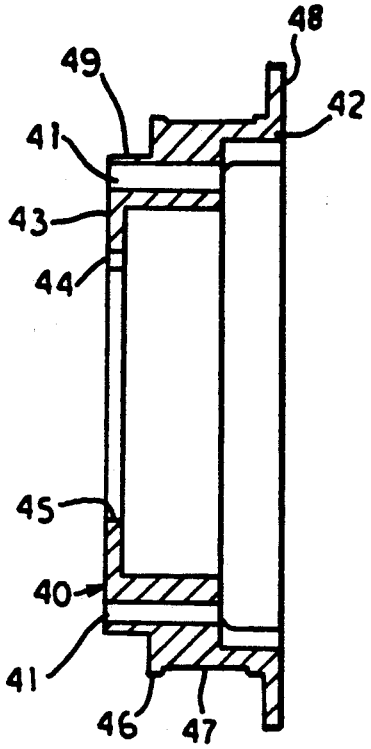
FIG. 8 is a cross sectional view taken on line 8—8 of FIG. 7.
Figure 9:
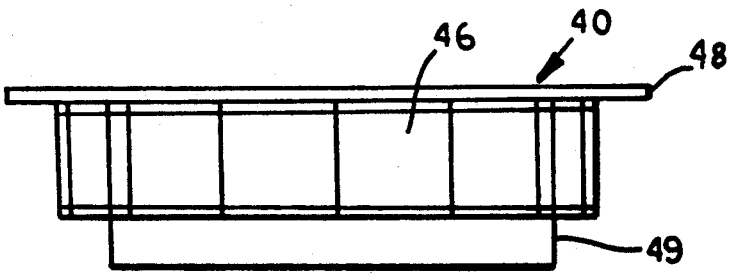
FIG. 9 is a top view of the rotor end segment shown in FIG. 7.
Figure 10:
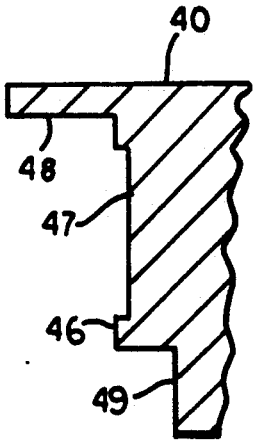
FIG. 10 is an enlarged partial cross sectional view of the rotor end segment shown in FIG. 8.

Rotor 14 is rotatably received in cylindrical shell 12 and fixed to rotor shaft 18. Rotor 14 is driven by motor 17, at a relatively high speed, independent of cylindrical shell 12 which is driven at a much slower speed. Bearing assembly 20, shown in FIG. 6, receives rotor shaft 18 which supports rotor 14 and cylindrical shell 12. Bearing assembly 20 includes bearing sleeve 21 which is supported on pillow block 22.

Cylindrical shell 12 has end plates 23 with central bores 24 and is fixed to the outer periphery of end plates 23. Central bores 24 of end plates 23 receive shell bearing 25. Shell bearing 25 receives an end of sleeve extension 26. Sleeve extension 26 concentrically receives rotor shaft 18 with a clearance therebetween. Outer sleeve part 27 is clamped to sleeve extension 26 by screws 28. Rotor bearing 29 is received in outer sleeve part 27. Outer race 30 of rotor bearing 29 is received in counterbore 31 in outer sleeve part 27. Inner race 32 of rotor bearing 29 receives rotor shaft 18 and is locked to rotor shaft 18 by nut 33. Sleeve extension 26 and outer sleeve part 27 are received in pillow block 22.

Inner oil seal 34 and outer oil seal 35 are supported on rotor shaft 18. Inner oil seal 34 is received in counterbore 38 in sleeve extension 26. Oil is supplied to bearing assembly 20 through oil receptacle 37.

Rotor 14 is made up of end segments 40 and intermediate segments 50 which receive rotor shaft 18. End segments 40 each have holes 41, generally cylindrical flange 42 with outwardly extending shunt flange 48, inwardly extending flange 43 with bore 45, key way 44 and polygonal shaped periphery made up of flat surfaces 46 which may have undercuts 47. Reduced size cylindrical part 49 is telescopically received under cylindrical flange 52 of the adjacent intermediate segments 50.

Intermediate segments 50 have a polygonal shaped outer periphery made up of flat surfaces 56 With undercuts like undercuts 47, inwardly extending flange 53 with central bore 55, key way 54 and holes 51. End segments 40 and intermediate segments 50 are held together by threaded rods 58 and nuts 59.

Flat surfaces 46 and 56 are aligned with one another and provide continuous flat surfaces extending from one end of rotor 14 to the other end. Plate-like rare earth permanent magnets 90 are supported on flat surfaces 46 and 56 and form continuous rows of magnets extending from end to end of rotor 14.

Spaces between plate-like rare earth permanent magnets 90 are filled with epoxy 91 and fibers 89 or filaments are passed through a liquid epoxy material and wound around plate-like rare earth permanent magnets 90 under sufficient tension to exert at least as great a compressive force on plate-like rare earth permanent magnets 90 as the centrifugal force exerted on plate-like rare earth permanent magnets 90 by rotation of rotor 14 at its design speed.

Rotor 14 is clamped to rotor shaft 18 by locking assembly 60 which is a clamping structure familiar to persons skilled in the art. Locking assembly 60 has outer clamping ring 62, inner clamping ring 63, frustoconical pilot bushings 64, studs 65 and end ring 66. Outer clamping ring 62 has an outside cylindrical surface that rests on cylindrical flange 42 of end segment 40 and an inner surface that is V-shaped in cross section. Frustoconical pilot bushings 64 rest on the inner V-shaped surface of outer clamping ring 62 and the inner V-shaped surface of inner clamping ring 63. Studs 65 have heads that rest on end ring 66. Studs 65 press through end ring 66, frustoconical pilot bushings 64 and threadably engage inwardly extending flange 43 of end segments 40. When studs 65 are tightened, frustoconical pilot bushings 64 are pulled together and the frustoconical surfaces of frustoconical pilot bushings 64 engage the inner V-shaped surfaces of clamping ring 62 and inner clamping ring 63 which forces outer clamping ring 62 and inner clamping ring 63 away from one another, clamping rotor 14 to rotor shaft 18.

Figure 11:
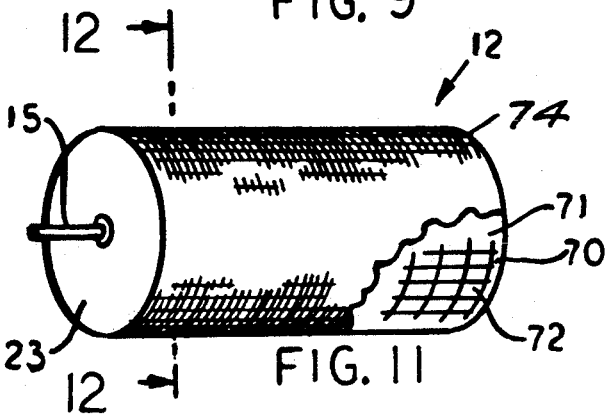
FIG. 11 is an isometric view of an embodiment of the rotor with a heat shield around the cylindrical shell.
Figure 15:
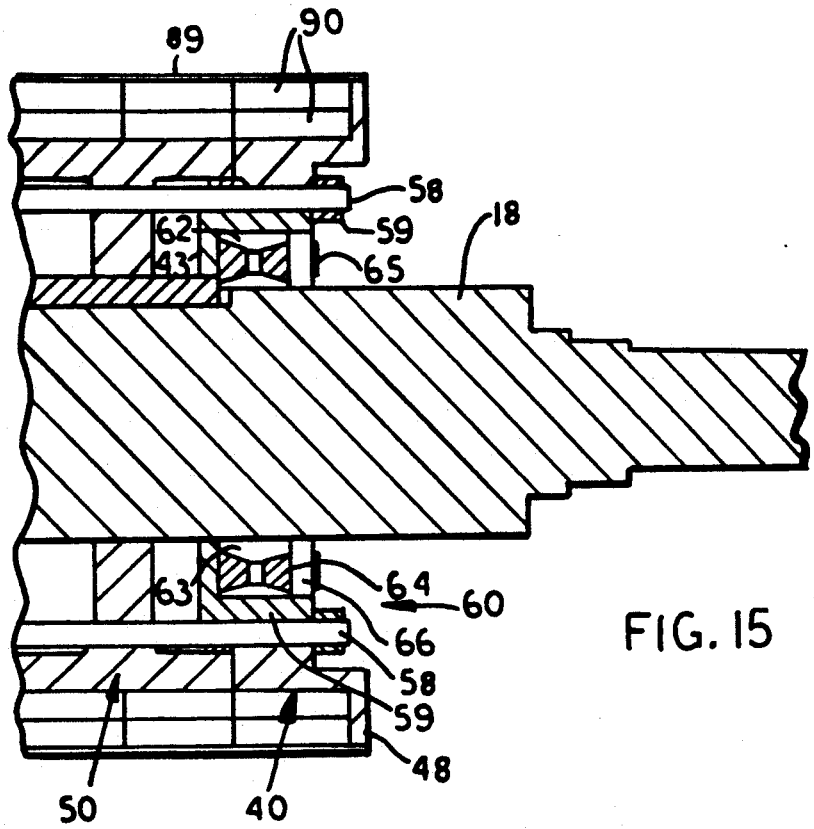
FIG. 15 is a partial cross sectional view taken on line 15—15 of FIG. 14.
Figure 16:
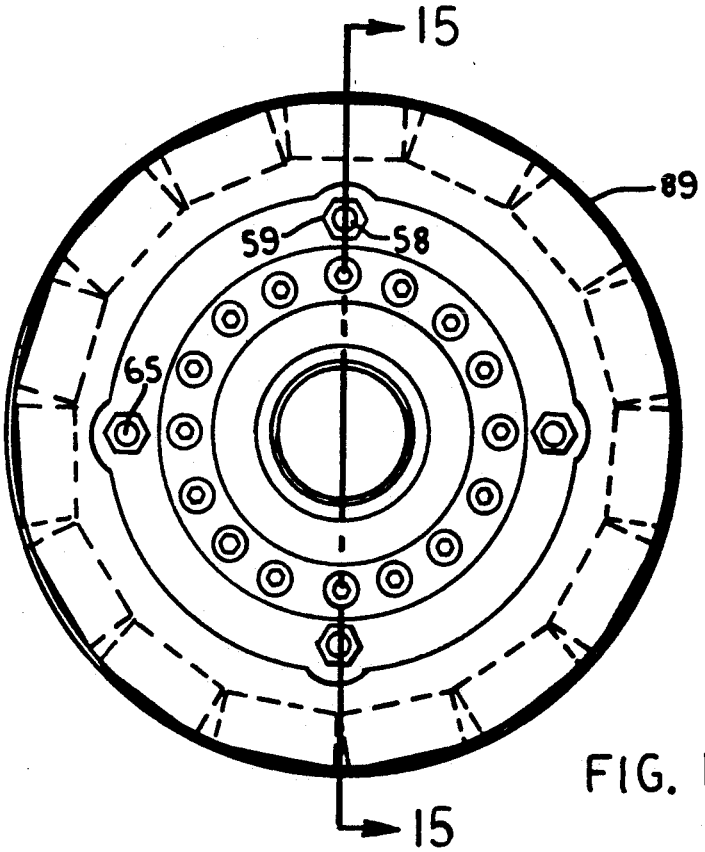
FIG. 16 is an end view of the rotor according to the invention.

Referring to FIGS. 11 and 12, cylindrical shell 12 has a hollow cylindrical body 71 made of an electrically nonconductive glass fiber reinforced plastic material having an outer cylindrical periphery and end plates 23. Heat shield 70 is made of ceramic tiles 72 or other refracting material and is supported on the outer periphery of hollow c body 71 and held in place by fiberglass net 74. A piece of magnetic material such as a steel nut or other magnetic material could fall off the side of belt 11 and become magnetically attracted to the outside periphery of cylindrical shell 12. Since rotor 14 rotates at a different speed than cylindrical shell 12, eddy currents would be induced in the magnetic material causing the magnetic material to get very hot. Without heat shield 70, the hot material could burn through fiberglass cylindrical body 71 and damage rotor 14. The ceramic tile 72 on cylindrical shell 12 will protect rotor 14 from damage caused by the magnetic material that might get onto cylindrical shell 12.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A rotor for an eddy current separator comprising a rotor body having generally cylindrical, outer peripheral surfaces designed to be rotated at a design speed;

plate-like rare earth permanent magnets;

adhesive means attaching said plate-like rare earth permanent magnets to said outer peripheral surfaces of said rotor body at a bond line;

said plate-like rare earth permanent magnets being disposed in longitudinal rows extending from one end of said rotor to the other;

said plate-like rare earth permanent magnets in a particular row having a polarity on their outer end opposite the polarity of an outer end of said plate-like permanent magnets in adjacent rows;

a fiber means wrapped around said plate-like permanent magnets under a tension sufficient to exert a compressive force on said plate-like permanent magnets at least as great as the centrifugal force exerted on said plate-like permanent magnets when said rotor is rotated with a rotor shaft at said design speed whereby substantially no tensile stress exists in said bond line of said adhesive means; and, said fiber means having said adhesive means thereon forming a matrix for said fiber means.

2. The rotor recited in claim 1 wherein said fiber means are embedded in said adhesive means applied during winding.

3. The rotor recited in claim 1 wherein said fiber means is made of a material having properties of tensile strength, elongation and a modulus of elasticity substantially equal to that of carbon.

4. A rotor for an eddy current separator comprising a rotor body having generally cylindrical, outer peripheral surfaces designed to be rotated at a design speed;

plate-like rare earth permanent magnets;

adhesive means attaching said plate-like rare earth permanent magnets to said outer peripheral surfaces of said rotor body at a bond line;

said plate-like rare earth permanent magnets being disposed in longitudinal rows extending from one end of said rotor to the other;

said plate-like rare earth permanent magnets in a particular row having a polarity on their outer end opposite the polarity of an outer end of said plate-like permanent magnets in adjacent rows;

fiber means wrapped around said plate-like permanent magnets under a tension sufficient to exert a compressive force on said plate-like permanent magnets at least as great as the centrifugal force exerted on said plate-like permanent magnets when said rotor is rotated with a rotor shaft at said design speed whereby substantially no tensile stress exists in said bond line of said adhesive means;

said fiber means having said adhesive means thereon forming a matrix for said fiber means;

said rotor body is made up of two end segments;

each said end segment having a generally cylindrical, outwardly directed, flange and an inwardly extending flange integrally attached to said end segment;

said inwardly extending flange having a central bore;

said central bore having a key way therein;

said central bore being adapted to receive said rotor shaft; and, said key way being adapted to receive a key whereby said end segments are keyed to said rotor shaft.

5. The rotor recited in claim 4 wherein said rotor has a plurality of intermediate segments between said end segments;

each said intermediate segment having a generally cylindrical, outwardly directed, flange and an inwardly extending flange integrally attached to said intermediate segment;

said inwardly extending flange having a central bore;

said central bore having a key way therein;

said central bore being adapted to receive said rotor shaft; and, said key way in each said intermediate segment adapted to receive a key whereby said intermediate segments are keyed to said rotor shaft.

6. The rotor recited in claim 4 wherein said generally cylindrical outer flange is polygonal in shape forming said outer peripheral surface of said rotor.

7. In combination, a rotor for an eddy current separator and a cylindrical shell concentrically receiving said rotor;

said rotor adapted to be rotated at a design speed;

said rotor having a generally cylindrical body supported on a rotor shaft;

said cylindrical body having a polygonal outer periphery;

said polygonal outer periphery having a plurality of circumferentially disposed adjacent flat surfaces of equal width extending longitudinally of said rotor from end to end thereof;

plate-like rare earth permanent magnets having a width substantially equal to the width of sides of said polygonal outer periphery and attached to said flat surfaces by adhesive;

said plate-like rare earth permanent magnets extending substantially continuously from end to end of said rotor;

said shell being made of an electrically non-conductive material and adapted to receive said rotor;

a heat shield being made of a refractory material supported on and substantially covering an outside periphery of said, shell.

8. The combination recited in claim 7 wherein said rotor is supported on said rotor shaft;

a pillow block means adapted to be supported on a supporting surface;

a bearing sleeve supported on said pillow block means;

a rotor bearing means received in said bearing sleeve;

said bearing sleeve having a sleeve extension extending over said rotor shaft;

a shell bearing means received on said sleeve extension and supporting said shell.

9. The combination recited in claim 8 wherein said shell comprises a hollow cylindrical member with end plates; and, each said end plate having a bore adapted to receive said shell bearing means.

10. The combination recited in claim 7 wherein said refractory material is ceramic.

11. The combination recited in claim 10 wherein said refractory material is in the form of generally rectangular pieces.

12. The combination recited in claim 11 wherein said refractory material is held in place by a net of fiberglass refractory material.

13. The combination recited in claim 7 wherein a pulley is supported in spaced relation to said rotor;

a belt supported on said pulley and on said heat shield;

first drive means connected to said pulley to drive said pulley at a first speed; and, second drive means connected to said rotor to drive said rotor at a second speed.

* * * * *